United States Patent [19]

Labrande

[11] 4,269,267

[45] May 26, 1981

[54] FIN AND TUBE ASSEMBLY AND A METHOD OF MAKING THE ASSEMBLY

[75] Inventor: Jean-Paul Labrande, Rambouillet, France

[73] Assignee: Societe Anonyme Francaise du Ferodo, France

[21] Appl. No.: 936,748

[22] Filed: Aug. 25, 1978

[30] Foreign Application Priority Data

Sep. 9, 1977 [FR] France ..... 77 27358

[51] Int. Cl.[3] ..... F28F 1/32

[52] U.S. Cl. ..... 165/181; 29/157.3 A; 29/157.3 B

[58] Field of Search ..... 165/110, 151, 181, 182; 29/157.3 A, 157.3 B, 157.3 C

[56] References Cited

U.S. PATENT DOCUMENTS

| | | | |
|---|---|---|---|
| 1,502,301 | 7/1924 | Fedders | 165/151 |
| 3,433,300 | 3/1969 | Pasternak | 165/151 |
| 3,603,384 | 9/1971 | Huggins et al. | 165/151 X |
| 3,771,595 | 11/1973 | Slaasted | 165/151 |
| 3,976,126 | 8/1976 | Ruff | 165/151 X |

*Primary Examiner*—Stephen Marcus

*Attorney, Agent, or Firm*—Roylance, Abrams, Berdo & Farley

[57] ABSTRACT

A fin and tube assembly for a heat exchanger, and a method of making the assembly. A fin and tube assembly for a heat exchanger, such as a motor vehicle radiator, comprises a plurality of apertured fins in stacked relation traversed by one or more tubes. The or each tube is of oblong cross section with initially flat flanks interconnecting rounded ends. After deformation by expansion or distension which exceeds the elastic limit along the rounded ends, the tube is in intimate contact with the similarly configured apertures or collars with which they may be lined, with the longitudinal sides of tube bearing under pressure against inwardly protruding convex edges which define part of the apertures. Alternatively, the tube may be initially of quasi-elliptical cross section and connected to a source of negative pressure to effect a deformation thereof prior to its introduction through the apertures.

11 Claims, 5 Drawing Figures

FIN AND TUBE ASSEMBLY AND A METHOD OF MAKING THE ASSEMBLY

The present invention relates to a fin and tube assembly for heat exchangers, particularly motor vehicle radiators, and a method of making such an assembly.

The manufacture of heat exchangers, like motor vehicle radiators, poses the problem of assembling parallel tubes in which flows a primary fluid, e.g. water, with fins protruding from the tubes and over which flows a secondary fluid, e.g., air.

According to a well-proven technique thin-walled tubes of circular cross section are inserted into aligned apertures, usually lined with collars, of a stack of fins, and they are then distended or expanded with an expander die of cross section greater than the initial cross section of the tubes or by pressurized fluid so that the outer surfaces of the tubes are forced against the inner surfaces of the collars or the edges defining the apertures in the fins, enhancing the intimacy of contact and therefore the thermal conductivity between the tubes and fins.

Moreover, tubes of oblong cross section have been used with a view to increasing the surface of the tube swept by the secondary fluid, i.e. the air, and also to diminish their aerodynamic resistance to the flow of air. To the present, however, the assembling of fins and tubes has required relatively complicated techniques such as welding in order to provide satisfactory heat exchange.

Even by making use of fins having apertures lined with frusto-conical collars in which the tapered end is smaller than the tubes intended to be inserted in the apertures, the results are not entirely satisfactory.

According to the invention there is provided a method of assembling a thin-walled tube of oblong cross section, more particularly a cross section presenting two curvilinear ends interconnected by straight line segments, with the fins of a plurality of a stacked parallel fins having apertures in alignment with one another, and in which the elasticity of the thin wall of the tube is used in order to obtain its intimate contact against the collars lining the apertures in the fins or against the edges defining said apertures.

According to a preferred method of assembly, the apertures for the tubes in the fins are sized sufficiently larger than the cross section of the tubes to permit easy insertions of the tube into a series of parallel fins, the outlines of the apertures being non parallel to the outline of the external surface of the tube when the longitudinal axis of the tube is identical to the axis of alignment of the apertures, the latter having rounded ends more distant from the rounded ends of the external surface of the tube than the interconnecting portions of said ends with respect to the flat flanks of the tube and, after insertion of the tube through the apertures in the fins, the tube is expended in such a way that its rounded ends are forced under pression against the rounded ends of the apertures or the collars, the expansion being such that the deformation of the rounded ends of the tube exceeds the limit of elastic deformation and is a plastic deformation, the flanks of the tubes are elastically urged by the plastic deformation of the rounded ends against the portions of the apertures or collars interconnecting the rounded ends.

According to another method of assembly, the tube is shrinked prior to its insertion through the aligned apertures of a plurality of parallel stacked fins, for example by the use of atmospheric pressure when the interior of the tube is connected with a source of depression, the atmospheric pressure being then re-established inside the tube, the wall of the tube being elastically applied against the edges defining the apertures in the fins against the collars edging the apertures.

According to an important aspect of the invention, the outline of the oblong aperture in a fin has on its long sides a curvature with a convexity facing the inside of the aperture such that the longitudinal portion of the edges defining the apertures facing one another protrude inwardly of the aperture.

The invention also concerns the assembly constituted by a tube having an oblong cross section and a multiplicity of parallel stacked fins, the walls of the tube being applied under pressure along its periphery against the edges of the apertures, these being for example provided with collars.

The following description, given by way of example, makes reference to the accompanying drawings, in which.

Figure 1:
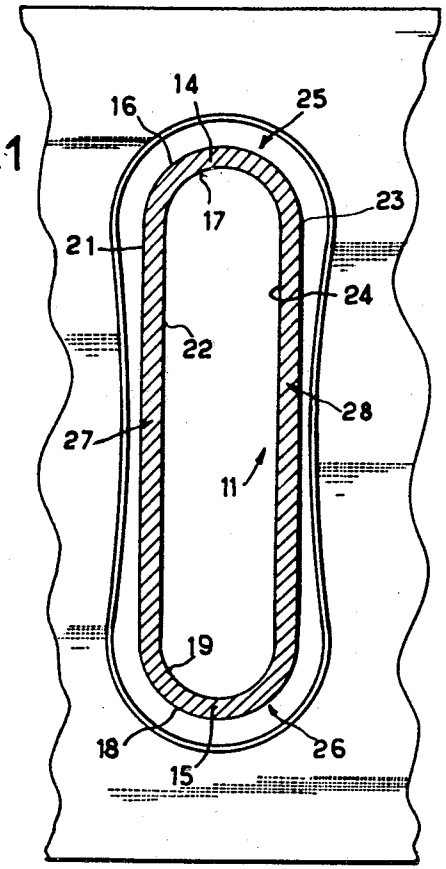
FIG. 1 is a cross sectional view of a tube in the course of insertion into an aperture in a fin.
Figure 4:
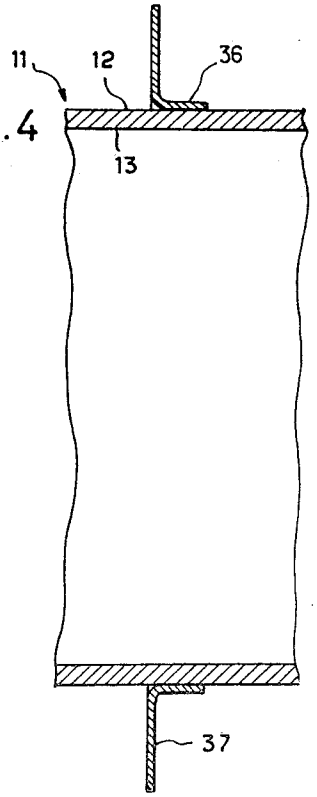
FIG. 4 is a fragmentary cross sectional view taken on the line 4—4 in FIG. 3.

The Tube 11 (FIGS. 1 and 4) of uniform thickness is a thin-walled tube with a wall thickness of the order of 0.1 to 0.5 mm having an outer surface 12 and an inner surface 13. The tube is formed by drawing and is of oblong cross section. The two rounded ends 14 and 15 of its cross section (FIG. 1) are defined between semi-circles 16, 17 and 18, 19 respectively. The semi-circles are connected by pairs of straight line segments 21, 22 and 23, 24. The tube 11 thus comprises two hollow semicylindrical portions 25, 26 of part circular cross section interconnected by two plane portions or flanks 27, 28.

Figure 2:
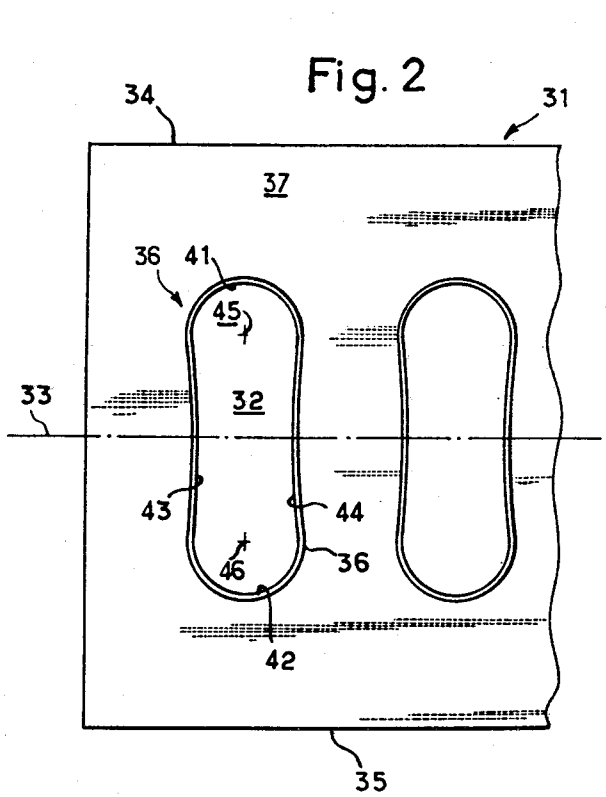
FIG. 2 is a front view of part of a fin.

Each fin 31 of a series or stack of fins of rectangular configuration comprises a plurality of apertures 32 for tubes (FIG. 2), of generally oblong contour, symmetrically aligned relative to the center line 33 of the fin equidistant its longitudinal edges 34 and 35; the long sides of the oblong apertures are, in the illustrated embodiment, substantially perpendicular to center line 33. Alternatively, however, the arrangement of the apertures relative to the center line may be otherwise. Each aperture 32 is lined with collars 36 which project perpendicularly to the body 37 of the fin 31.

Each aperture 32 has a sectional area larger that the outer cross section of tube 11 so that the tube may be readily inserted into the aligned apertures 32 of the plurality of fins 31 in stacked relation. With heat exchangers comprising a plurality of parallel tubes, like motor vehicle radiators, the plurality of heat exchanger tubes are inserted simultaneously into apertures in the plurality of fins in stacked relation.

The portion of fin defining each aperture 32 has, in cross section, two opposed curvilinear edges 41 and 42, interconnected by edges 43 and 44. In the described embodiment, the rounded edges 41 and 42 are part circular, with centers 45 and 46 the radii of which are greater than the radii of semi-circles 16 and 18 of the outer cross section of each tube. The edges 43 and 44 defining the longitudinal sides of the apertures are slightly convex and protrude into their associated apertures; these longitudinal sides are, for instance, part circular the radii of which are very much greater than that of part circular edges 41 and 42. Each apertures 32 thus has a slotted configuration slightly narrower or necked at its midsection relative to its slightly bulging ends.

A tube 11 is inserted into the coaxial apertures 32 of a plurality of fins 31 in stacked relation, there being some play or clearance between the outer surface of the tube 11 and the edges defining the apertures 32, the rounded ends 14 and 15 of the tube 11 are expanded or distended so that their outer surfaces are forced against the rounded edges 41 and 42 of the apertures 32, the deformation of the rounded ends 14 and 15 of the tube exceeding the elastic limit, that is to say, there is plastic deformation.

This distention or expansion of the tube may be carried out with a bulb-shaped expander die.

Figure 3:
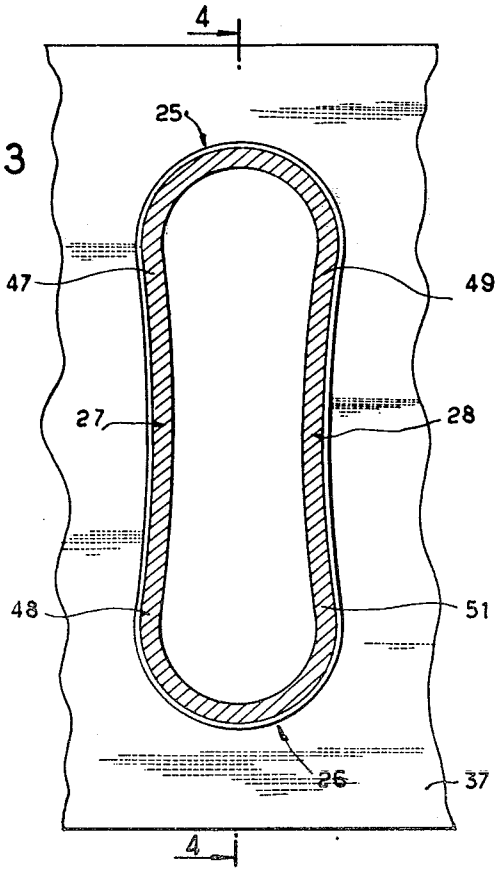
FIG. 3 is a view similar to FIG. 1 after distending or expanding the tube.

By such plastic deformation of the rounded ends 14 and 15 the flat portions or flanks 27 and 28 of the tube 11 are also deformed, each of them being urged at its connecting zones 47, 48 and 49, 50 (FIG. 3) with the rounded ends 14 and 15 and bearing against the facing edges defining part of the apertures 32. The plastic deformation of the rounded ends 14 and 15 brings about an elastic deformation of the flanks 27 and 28 which have the tendency to return to their initial plane configuration after the rounded ends have been deformed. The inwardly protruding convex edges 43 and 44 defining the sides of the apertures 32 prevent the flanks 27 and 28 from returning to their flat configuration; the flanks, therefore, resiliently bear under pressure against the inwardly protruding edges 43 and 44 defining part of the apertures in the fins, which may be provided with collars. The configuration of each of the apertures in the fins is such that the deformation of the flanks 27 and 28 does not exceed the elastic limit.

Under these circumstances, when the stress exerted on the rounded ends has been removed, the outer surfaces of the rounded ends 14, 15 of the tube 11 are in intimate contact with the inner surfaces of the rounded ends of the collars 36 and the outer surfaces of the flanks 27 and 28 are resiliently urged against the inner surfaces of the collars 36 having a large radii of curvature.

Intimate contact is thus achieved between the tube 11 and the collars 36 in the fin apertures (FIG. 3) promoting good heat transfer between tube and fins.

The invention also contemplates arrangements in which the apertures in the fins are not lined with collars.

Figure 5:
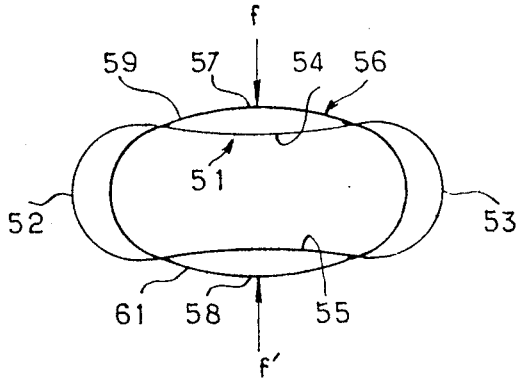
FIG. 5 is a diagrammatic view illustrating another method of making the fin and tube assembly.

According to a modified embodiment (FIG. 5), the apertures 51 in the fins are again oblong, with part circular edges 52 and 53 interconnected by inwardly protruding edges 54 and 55, the oblong tube 56 has an initially oval cross section which is more or less elliptical.

Before being inserted into the coaxially aligned apertures 51, the tube is deformed by forces as illustrated schematically by arrows f and f' tending to bring the mid-sections 57 and 58 of the opposed flanks 59 and 61 together. Such a deformation of the tube may be produced by connecting the interior of the tube 56 to a source of depression. The thus deformed tube is inserted into the apertures 51 after which atmospheric pressure is reestablished inside the tube 56. Owing to the resilience of the metal forming the tube, the tube bears against the edges defining the apertures 51, which may be lined with collars.

What is claimed is:

1. A heat exchanger comprising a plurality of tubes mounted in apertures in a plurality of fins to extend transversely thereto, said apertures being oblong in cross section with relatively small ends and relatively long, convex sides extending into said apertures, said tubes being oblong with relatively small ends and relatively long flanks in cross section, said tube ends being plastically deformed to mate with said small ends of said apertures to cause said tube flanks to be elastically urged against said convex sides of said aperture.

2. A heat exchanger according to claim 1, wherein said aperture ends are rounded.

3. A heat exchanger according to claim 2, wherein said convex sides are curved.

4. A heat exchanger according to claim 1, wherein said convex sides are curved.

5. A heat exchanger according to claim 1, wherein said tube flanks are essentially planar when unstressed.

6. A heat exchanger according to claim 1, wherein said tube flanks are essentially planar and parallel when unstressed.

7. A heat exchanger according to claim 1, wherein collars extend from the periphery of said apertures.

8. A heat exchanger according to claim 1, wherein collars extend transversely from the periphery of said apertures.

9. A heat exchanger comprising a plurality of tubes mounted in apertures in a plurality of fins to extend transverely thereto, said apertures being oblong in cross section with relatively small rounded ends and relatively long, curved convex sides extending into said apertures, said convex sides having a radius of curvature substantially greater than the radius of curvature of said aperture ends, said tubes being oblong with relatively small ends and relatively long flanks in cross section, said tubes being in a deformed condition in said apertures to cause said tube ends to mate with said aperture ends and said tube flanks to be elastically urged around said curved convex sides of said apertures to conform therewith so as to maintain close continuous contact between said flank and said convex sides.

10. A heat exchanger comprising a plurality of tubes mounted in apertures in a plurality of fins to extend transverely thereto, said apertures being oblong in cross section with relatively small rounded ends and relatively long curved convex sides extending into said apertures, said convex sides having a radius of curvature substantially greater than the radius of curvature of said aperture ends, said tubes being oblong with relatively small ends and relatively long flanks in cross section, said tube ends fitting around said aperture ends, said flanks being elastically stretched between said tube ends and urged against said curved convex sides of said apertures in close continuous contact therewith.

11. A product of a process for forming a heat exchanger, the process comprising locating a plurality of tubes in apertures in plurality of fins to extend transversely relative thereto, said apertures being oblong in cross section with relatively small ends and relatively long, convex sides extending into said apertures, said tubes being oblong in cross section with relatively small ends and relatively long, parallel flanks in cross section; and plastically deforming said tube ends to mate with said aperture ends to cause said tube flanks to be elastically urged against said convex sides of said aperture.

* * * * *